US006397798B1

(12) United States Patent
Fiaccabrino

(10) Patent No.: US 6,397,798 B1
(45) Date of Patent: Jun. 4, 2002

(54) METHOD AND DEVICE FOR ELECTROMAGNETIC VALVE ACTUATING

(75) Inventor: Calogero Fiaccabrino, Cergy (FR)

(73) Assignee: Sagem SA, Paris (FR)

( * ) Notice: Subject to any disclaimer, the term of this patent is extended or adjusted under 35 U.S.C. 154(b) by 0 days.

(21) Appl. No.: 09/807,191

(22) PCT Filed: Oct. 14, 1999

(86) PCT No.: PCT/FR99/02495

§ 371 (c)(1),
(2), (4) Date: Apr. 10, 2001

(87) PCT Pub. No.: WO00/22283

PCT Pub. Date: Apr. 20, 2000

(30) Foreign Application Priority Data

Oct. 15, 1998 (FR) ..... 98 12940

(51) Int. Cl.[7] ..... F01L 9/04
(52) U.S. Cl. ..... 123/90.11; 251/129.18
(58) Field of Search ..... 123/90.11; 251/129.18; 137/553

(56) References Cited

U.S. PATENT DOCUMENTS 5,131,624 A * 7/1992 Kreuter et al. ..... 251/129.18
5,269,269 A * 12/1993 Kreuter ..... 123/90.11
5,785,016 A * 7/1998 Enderle et al. ..... 123/90.11
5,797,360 A * 8/1998 Pischinger et al. ..... 123/90.11
5,832,955 A * 11/1998 Schrey ..... 137/551
6,070,853 A * 6/2000 Stolk et al. ..... 251/129.18

* cited by examiner

*Primary Examiner*—Thomas Denion
*Assistant Examiner*—Ching Chang
(74) *Attorney, Agent, or Firm*—Larson & Taylor, PLC

(57) ABSTRACT

The electromagnetic valve actuator has a valve drive armature and return springs provided to hold the valve in a determined rest position substantially halfway between two extreme positions namely a valve closed position and a valve open position. An electromagnetic unit has a ferromagnetic core placed on both sides of the armature and a power supply circuit. The power circuit calculates the velocity with which the armature approaches each of its extreme positions by measuring the current flowing through the electromagnetic unit and it applies a current to the electromagnetic unit which servo-controls variation of the velocity for compliance with a determined reference profile.

10 Claims, 3 Drawing Sheets

FIG. 2.
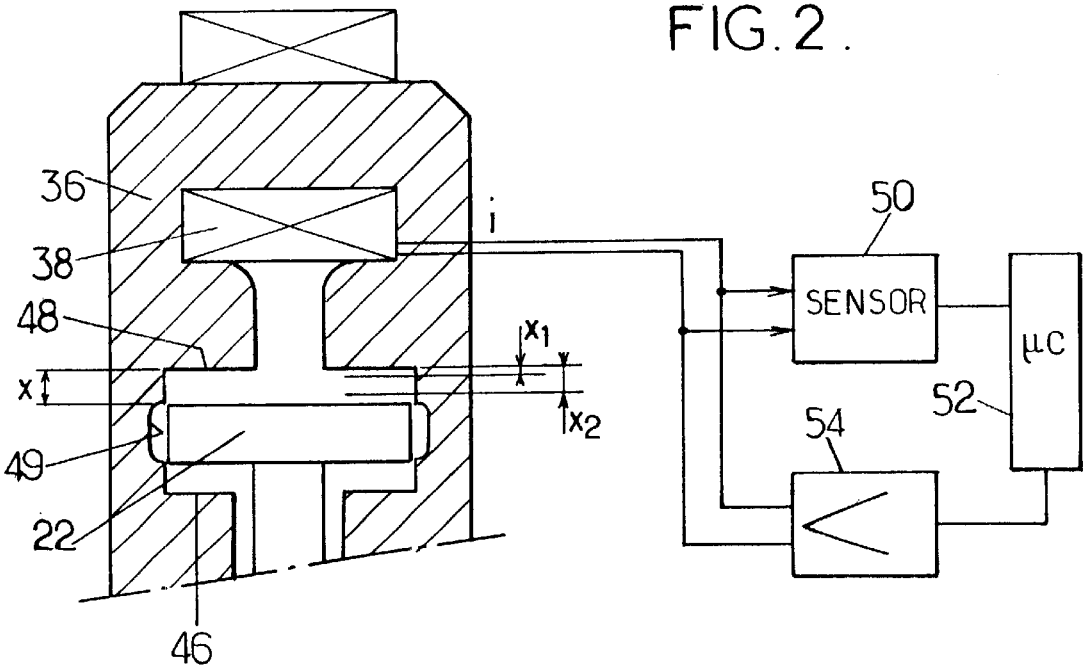
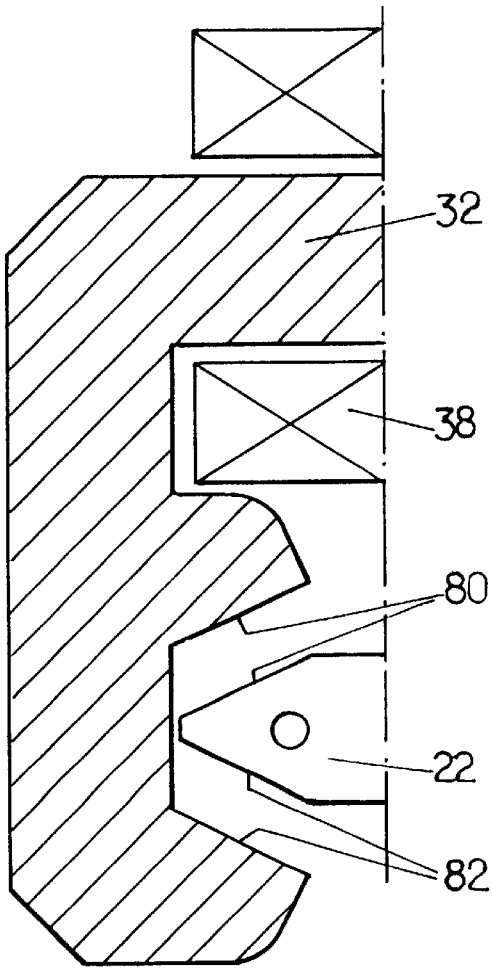
FIG. 5.

FIG.3.
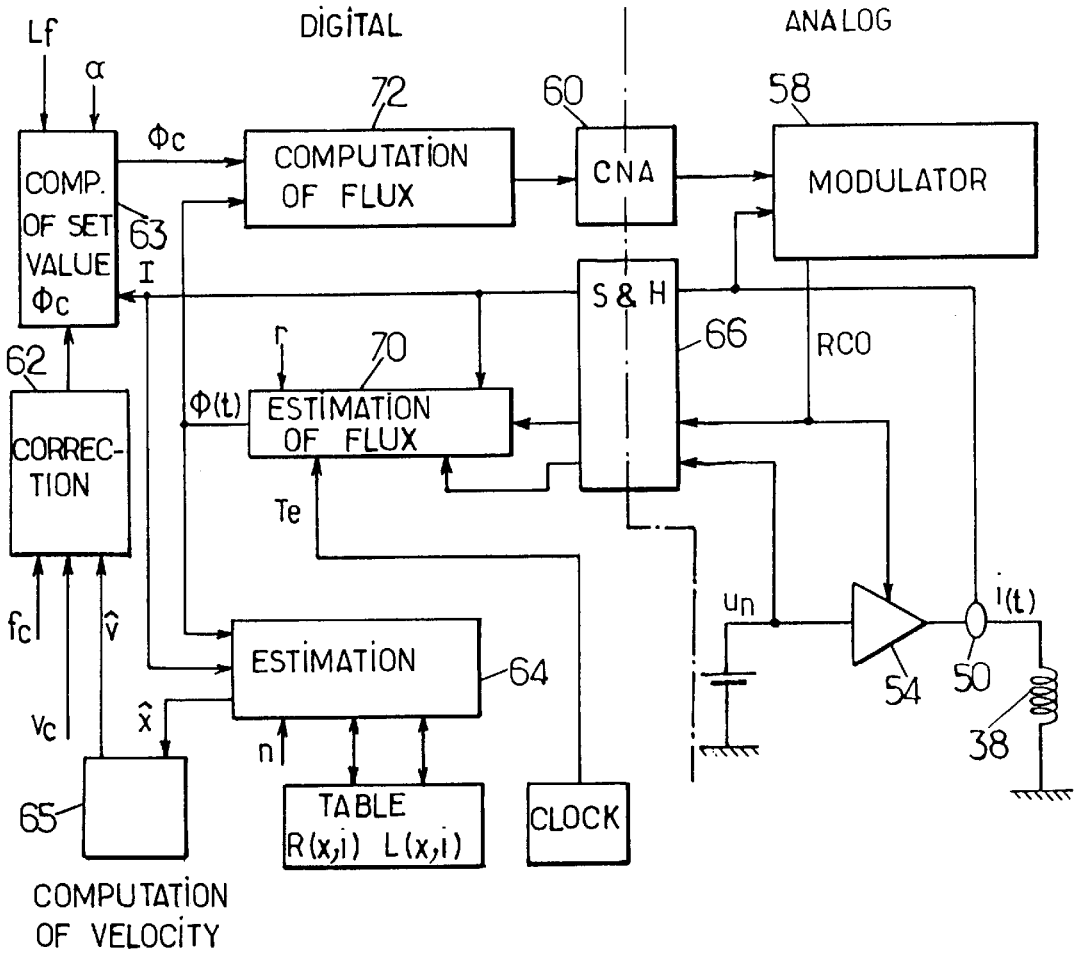
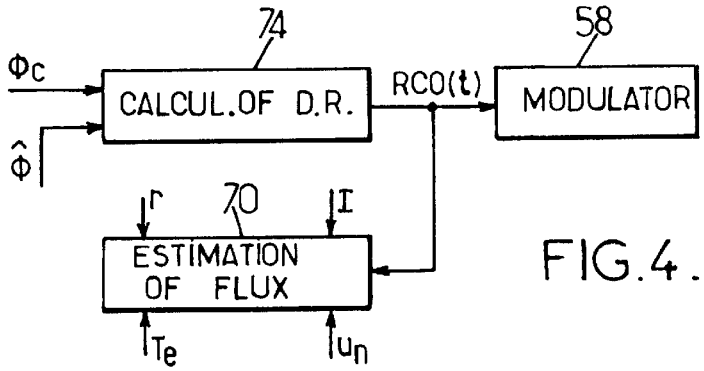
FIG.4.

METHOD AND DEVICE FOR ELECTROMAGNETIC VALVE ACTUATING

FIELD OF THE INVENTION

The invention relates to electromagnetic actuators for moving a valve in translation to bring it alternately into an open position and into a closed position. A major application lies in controlling the valves of an internal combustion engine, with spark ignition or compression ignition.

BACKGROUND OF THE INVENTION

An electromagnetic actuator is known (U.S. Pat. No. 4,614,170) having an armature of ferromagnetic material driving the stem of a valve, resilient return means provided to hold the valve at rest in a middle position between its fully open position and its closed position, and electromagnetic means enabling the valve to be brought into both positions in alternation. The electromagnetic means described in document U.S. Pat. No. 4,614,170 has a first electromagnet with a ferromagnetic core placed on one side of the armature so that when excited it attracts the armature in a direction that tends to close the valve, and a second electromagnet placed on the other side of the armature so that when excited it tends to bring the valve into the fully open position.

Another electromagnetic actuator is described in U.S. patent application of Porcher et al. Ser. No. 09/806,711, claiming the priority of French patent application No. 98/12489. The electromagnetic means of that actuator have a single coil mounted on a ferromagnetic circuit of structure such that, in combination with the armature, it presents two stable magnetic flux paths both corresponding to small and generally zero values for the airgaps between the armature and the ferromagnetic circuit.

Those electromagnetic actuators are actuated as follows. The electromagnetic means enable forces to be exerted suitable for bringing the armature into a "high" position which is assumed to correspond to the valve being closed, and into a "low" position which corresponds to the valve being open, and enabling the armature to be held in both of these positions. In the "high" position the equipment compresses a spring for storing mechanical energy so long as a suitable current passes through the coil, or the single coil holds the armature. When the holding current is switched off, the spring propels the moving equipment towards its "low" position. A rod fixed to the armature pushes the stem of the valve and compresses the closure spring of the valve. At the end of the armature stroke, a holding current is established in the coil or a suitable coil to ensure that the valve remains open. The closure spring of the valve serves in turn to store energy and when the holding current is switched off it acts in turn to propel the valve and the armature upwards.

Some of the mechanical energy is lost to friction, impacts, eddy currents, and energy consumption due to counter-pressure forces, in particular on exhaust. Consequently, it is necessary to exert an additional or "attracting" force that is added to the force exerted by the springs in order to compensate for energy losses each time the armature goes from one extreme position to the other.

The additional energy supplied must be sufficient to guarantee that the armature travels a full stroke, but it must not be excessive so as to avoid terminal impact which would generate noise and wear. In practice, the impact velocity must not exceed a few hundredths of a meter per second (m/s) if noise and wear are to be maintained at acceptable levels.

Existing electromagnetic methods and apparatuses have difficulty in complying simultaneously with the above two conditions in simple manner. Either they must accept a high impact velocity, or else they require the presence of a position and/or velocity sensor which complicates the method and the apparatus and which increases the cost of implementation.

The present invention seeks in particular to provide a method and apparatus for electromagnetic actuation of a valve that provides satisfactory control of the amount of energy applied, but without requiring a sensor.

To do this, the invention makes use of the fact that the ferromagnetic circuit of the electromagnetic means can be made in such a manner as to ensure that an almost linear relationship exists between its reluctance R(x) and the size of its airgap x during the last fractions of a millimeter of the stroke before the armature sticks against the ferromagnetic circuit(s). This property is to be found in particular with single-coil electromagnetic means of the kind described in above-mentioned patent application No. 98/12489. In such an actuator, the inductance L(x) of the coil also varies in quasi-linear manner over a range beginning from immediately beyond the central position of the armature if the notches of the ferromagnetic circuit are of substantially the same length as the thickness of the armature. Since it is possible to calculate R(x) and L(x) on the basis of the current i passing through the coil (or two coils in series), it is therefore possible to calculate x at almost all instants after the central position has been passed, and thus to deduce velocity therefrom.

Consequently, the invention proposes in particular an electromagnetic valve actuator comprising a valve drive armature, resilient return means provided to hold the valve at rest in a determined position substantially halfway between two extreme positions including a valve closed position, electromagnetic means having a ferromagnetic core placed on both sides of the armature, and a power circuit for applying power in alternation to said electromagnetic means, the actuator being characterized in that the power circuit includes means for calculating the velocity with which the armature approaches each of its extreme positions on the basis of measuring the excitation current in the electromagnetic means and means for applying a current to the electromagnetic means in order to servo-control variation of said velocity to a determined reference profile without using a position and/or velocity sensor in addition to the driving coil(s).

The calculation means can deduce the variation in reluctance from the current measurement during the last part of the armature approach stage, i.e. for small airgaps, and it is possible to deduce the variation of x vs. time from the variations in reluctance.

In an advantageous embodiment of the invention, the calculation means are also designed to calculate repetitively the inductance of the electromagnetic means when the airgap exceeds a determined value, thus making it possible to determine corresponding values for x, e.g. by looking them up in a table. Under such conditions, the regulation can control a velocity variation profile over a major fraction of the stroke of the armature. In the range over which the relationships giving variation in L and R as a function of the airgap x are not very linear, an approximate value can be obtained for x at any instant by finding the center of gravity of the values of x as obtained by interpolating values of L and R as a function of x, on the assumption that the interpolation can be linear.

By means of this structure, genuine regulation can be performed as opposed to mere open loop control or as opposed to merely controlling the current delivered during a cycle on the basis of results obtained during a preceding cycle of armature oscillation.

The invention also provides a method of controlling a valve using such an actuator, in which the current passing through the electromagnetic means is sampled, variations in L(t) and R(t) are deduced from the current by calculation, then variations of x are divided by referring to stored tables, the residual velocity is derived from variations in x over time, and the application of a voltage to the electromagnetic means is controlled in such a manner as to servo-control variations in time of x to a predetermined profile.

In practice, the zone in which variation in L or R is not linear can be very narrow. R varies almost linearly as a function of x so long as the airgap x does not exceed a value x1 of about 0.5 millimeters (mm), for an actuator whose electromechanical portions have the structure shown in patent application No. 98/12489. Inductance L varies in quasi-linear manner as a function of x as soon as x exceeds a value x2 which is typically about 1 mm when the thickness of the armature is substantially equal to the thickness of notches formed in the magnetic circuit.

The characteristics of L and R as a function of x can be obtained for other types of magnetic circuit, derived from that described in application No. 98/12489.

The above characteristics, and others advantageously usable in connection with the above but capable of being used independently, will appear more clearly on reading the following description of particular embodiments given as non-limiting examples.

BRIEF DESCRIPTION OF THE DRAWINGS

The description refers to the accompanying drawings, in which:

FIG. 2 is a detail view for showing the parameters involved;

FIG. 3 is a functional block diagram;

FIG. 4 shows a variant of FIG. 3; and

FIG. 5 shows a variant of the magnetic circuit that can be used.

DESCRIPTION OF THE PREFERRED EMBODIMENTS

Figure 1:
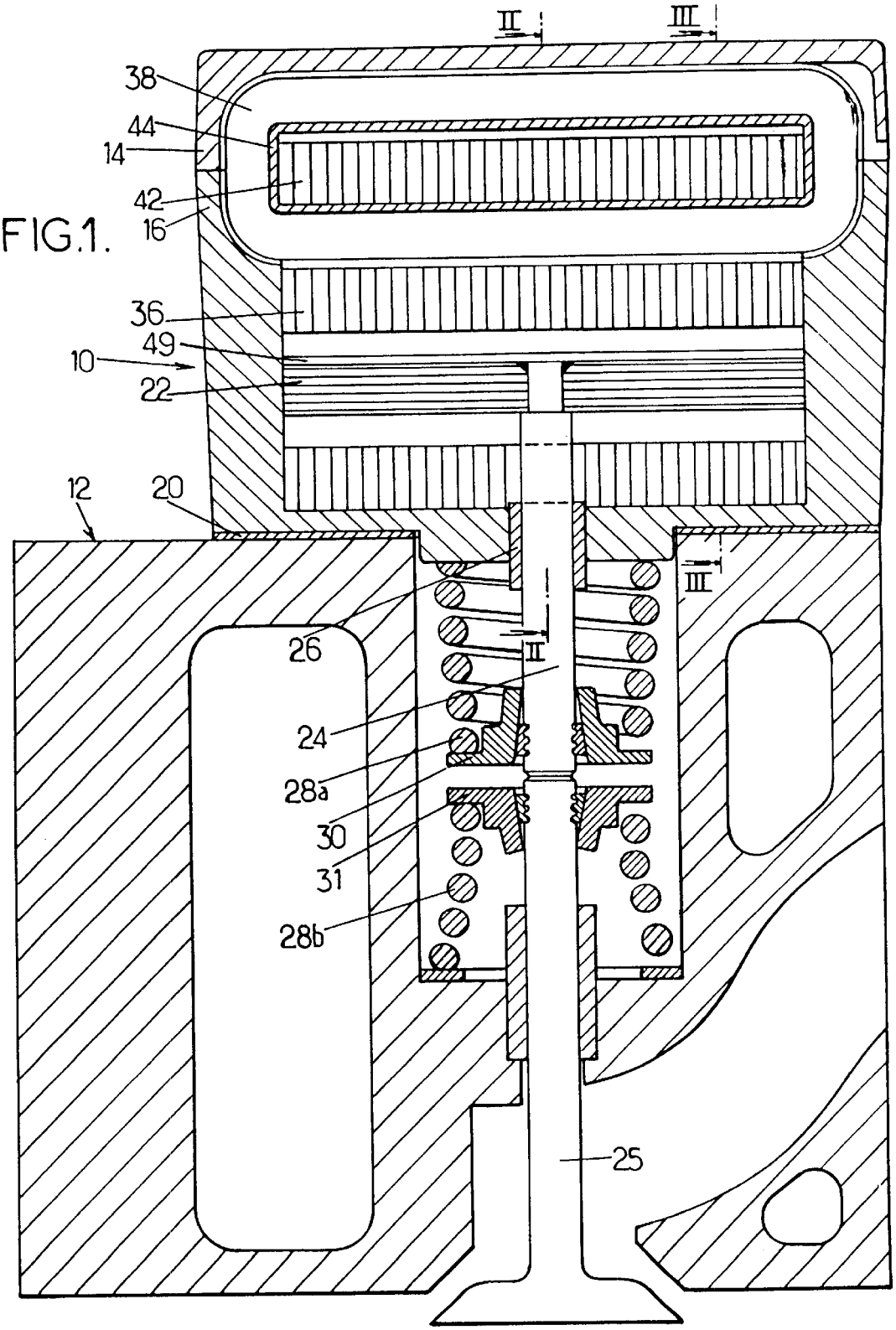
FIG. 1 shows an embodiment of a valve actuator in section on a plane containing the axis of the valve.

The actuator 10 shown in FIG. 1 is constituted by an assembly for mounting on the cylinder head 12 of an engine. It includes a housing made up of a plurality of parts 14 and 16 that are stacked and assembled together by means not shown (e.g. screws). These parts are made of a material that is not ferromagnetic, e.g. light alloy. The housing can be fixed to the cylinder head 12 via a piece of shim 20 that is likewise made of a material that is not ferromagnetic.

The housing contains a core of ferromagnetic material 36 which is advantageously laminated, cooperating with the armature to define a ferromagnetic circuit, and a coil 38 placed on the core. The core shown can be built up from two complementary portions, bearing one against the other, or else it can be made as a single piece. The laminations constituting each half of the core are E-shaped. The top branches 42 engage in the coil 38 which they support via a former 44. The other two branches of each half define a travel volume for the armature. The armature bears against the bottom 46 of the volume in a position that defines the fully open position of the valve. The ceiling 48 of the volume Is at a location relative to the valve seat such that when the armature is bearing against the ceiling it does not prevent the valve from closing. A middle notch 49 which corresponds to the rest position of the armature 22 can be provided in the chamber, and it can be of a length that is slightly greater than the thickness of the armature. Above and below the notch, the wall of the volume leaves only the clearance that is required for movement so as to reduce reluctance.

Two return springs 28*a* and 28*b* are provided to hold the valve at rest in a position substantially halfway between the closed position and the fully open position. One of the springs 28*a* is compressed between a plate 30 fixed to the rod 24 and the extension of the part 16. The other spring 28*b* is compressed between a plate 31 fixed to the stem of the valve and the bottom of a valve well formed in the cylinder head. Distribution clearance between the rod when raised and the valve when closed guarantees air-tightness. The actuator could equally well have used a single spring operating in traction and compression and/or associated with a resilient damper to ensure sealing when the valve is closed, as described in French patent No. 98/11670, thus making it possible for the rod and the valve stem to be constituted by a single piece.

The housing contains a core of ferromagnetic material 36 which is advantageously laminated, cooperating with the armature to define a ferromagnetic circuit, and a coil 38 placed on the core. The core shown can be built up from two complementary portions, bearing one against the other, or else it can be made as a single piece. The laminations constituting each half of the core are E-shaped. The top branches 42 engage in the coil 36 which they support via a former 44. The other two branches of each half define a travel volume for the armature. The armature bears against the bottom 46 of the volume in a position that defines the fully open position of the valve. The ceiling 48 of the volume is at a location relative to the valve seat such that when the armature is bearing against the ceiling it does not prevent the valve from closing. A middle notch 49 which corresponds to the rest position of the armature 22 can be provided in the chamber, and it can be of a length that is slightly greater than the thickness of the armature. Above and below the notch, the wall of the volume leaves only the clearance that is required for movement so as to reduce reluctance.

The assembly constituted by the armature, the valve, and the spring constitutes an oscillating system having a resonant frequency. Under steady conditions, the coil is powered so as to bring the moving equipment into an extreme position and is then held by a lower, holding current until the moving equipment is caused to move in the opposite direction.

In an actuator as shown, the reluctance R(x) of the magnetic circuit varies in substantially linear by so long as the value x of one of the airgaps is less than a value x1 which is generally about 0.5 mm. The inductance L(x) also varies substantially linear manner as a function of x so long as the airgap exceeds a value x2 of about 2 mm.

In order to implement the invention, the actuator has a power supply circuit (FIG. 2) with a sensor 50 of the current i flowing through the coil. Its output is used by a calculator circuit 52 which controls the voltage applied by a generator 54. A solution which is convenient because it enables calculation to be performed digitally, consists in sampling the signal i. A sampling frequency of 20 kHz will generally give satisfactory results. If the coil is fed with a voltage u, the inductance L(t) and reluctance R(t) can be obtained by a program for calculating the following integral:

$$L(t) = \left[\int_{To}^{T} [u(t) - ri(t)]dt + L(To)i(to)\right] \Big/ i(t)$$

$$R(t) = \frac{n^2}{L(t)}$$

where:

r is the known resistance of the coil (possibly corrected as a function of temperature);

the instant To is selected so that L(To)*i(To) is known; To is often selected so that i(To)=0; and n is the number of turns of the coil.

Current is servo-controlled by means of a regulation loop which compares the measured current i with a reference value. The observed difference enables control to be corrected in analog manner.

It is advantageous to use a circuit of the kind shown in FIG. 3 in which the calculator is constituted by a plurality of modules and controls the voltage u applied to the coil in the form of pulses at a fixed frequency fe, by using a pulse width modulator 58 to control a power switch that constitutes the generator 54. The modulator 58 provides a periodic output signal at a frequency fe of several tens of kHz and having a duty ratio DR.

In the embodiment shown, the integral giving L(t) is calculated in a total flux estimator on the basis of knowledge derived from a sample-and-hold circuit 66, of the duty ratio DR(k) applied over the sampling period k, of the duration te=1/fe, and of the nominal voltage Un applied by the switch 54:

$$\int_{To}^{T} u(t)dt = \sum_{k=Ko}^{K} te \cdot DR(k) \cdot Un(k$$

where:

Ko is such that To=Ko*te; and

K is such that T=K*te.

The voltage Un is known from the structure of the switching circuit and does not necessarily need to be acquired in real time.

The current I representing i(t) is presented to the calculator after the sample-and-hold circuit 66 has sampled it at an instant which is not disturbed by the switching of the modulator, and after an anti-aliasing filter has attenuated harmonics beyond fe/2. The integral of r*i(T) is calculated digitally by a method of summing integration areas, e.g. of the simple or the trapezoidal type.

L and R can thus be calculated at successive instants t; then a map giving R as a function of X and i makes it possible to derive x by linear interpolation knowing R and i, for x less than x1; and a map giving L as a function of x and i makes it possible to derive x by linear interpolation, given L and i, for x greater than x2.

Between x1 and x2, x can be estimated by taking the average of linear interpolations based on R and on L.

After filtering the estimated value $\hat{x}$ of x by means of a digital filter whose cutoff frequency is a few kHz, a differentiating operation in a velocity calculation module 65 provides an estimate $\hat{v}$ of the velocity throughout the stroke of a transition without there being any need for a special sensor. For a car engine, a frequency fe of 20 kHz and a cutoff frequency of 74 kHz generally give good results.

Before further describing the circuit shown in FIG. 3, the principles on which its operation is based will be described.

Comparing the estimated velocity $\hat{v}$ with a reference velocity profile determined by simulation and experiment makes it possible via a corrector 62 to generate the profile of the attraction force F(t) by finding a compromise between power consumption and delay in applying correction forces.

To improve control of the applied force F(t), it is advantageous for the reference current to originate from a servo-control loop which digitally servo-controls the flux $\phi(t)$ that contributes to delivering the magnetic force. This approach makes force control robust in the face of uncertainty concerning position, in particular at small airgaps. Thus, the set or reference value of the force, as calculated by the corrector 62, is converted by a module 63 into a reference value of the magnitude of the total flux $\phi(t)$, which is the same as the useful flux of the force in the leak flux associated with the leakage inductance Lf. The useful flux $\phi u$ can be written:

$$\phi(t)=\alpha F(t)^{1/2}$$

where $\alpha$ is a scale factor depending on the shape of the magnetic circuit and is determined by simulation and testing.

The reference value of the total flux, generated in a module 63, is given by the formula:

$$\phi c=\phi u+Lp.i(T)\phi c=\phi u+Lp\times i(T)$$

The reference flux $\phi c$ is compared with the estimated total flux:

$$\hat{\phi} = \int_{To}^{T} [u(t) - ri(t)]dt$$

This formula uses terms that are already available in the position estimator 64 and makes use of the leakage inductance Lf which is determined by simulation and testing.

Such a system thus operates with three interleaved closed loops: the first loop relates to speed; the second to useful flux; and the third to the current i in the coil.

In the circuit of FIG. 3, the position estimator 64 receives a digitized signal I representing the measured current i. On the basis of I, of flux $\phi$ and of stored tables R(x,i) and L(x,i), it operates at each sampling instant starting from the beginning To of a cycle, to generate position information which is transmitted to the module 65 for calculating the estimated actual velocity. The corrector 62 compares the actual velocity profile with the reference velocity profile vc and supplies a signal representative of the force to be exerted F(t) to the module 68 for calculating a reference flux $\phi c$ taking account of the leakage inductance Lf and of the coefficient $\alpha$. The reference current ic necessary for creating the flux $\phi c$ is calculated in a module 72 from the difference between $\phi c$ and the estimated total actual flux $\hat{\phi}(t)$. This estimated total actual flux is given by a module 70 on the basis of stored values r and Te, of the signal representative of the measured current i, of the nominal voltage of the generator, and of DR.

The digital signal representing the reference current is delivered to the pulse width modulator 58 by the digital-to-analog converter 60, and it compares this signal with I.

The corrector 62 can be designed to operate over certain fractions of a stroke to take account also of the reference force profile fc.

In FIG. 3, the three above-mentioned interleaved loops are shown as follows:

the current loop is constituted by the modulator 58, the sensor 50, and the comparator 54;

the flux loop is constituted by the total flux estimator, the reference flux calculator module, and the module 72 closing on the preceding loop; and the velocity loop comprises the position estimator 64 and the force calculator module, closing on the preceding loop.

The modules can be constituted by microelectronic components or by programs.

In a modified embodiment, shown in FIG. 4, the current loop is omitted. The reference current calculation module is replaced by a module 74 which calculates DR(t) directly and applies it to the modulator 58 which controls the time intervals during which the voltage u is applied.

In another variant, as shown in FIG. 5, wherein elements similar to those of FIG. 2 have been given the same reference numerals, the armature 22 is advantageously laminated and has edges that are chamfered parallel to the poles of the core as indicated at 80 and 82. Tabulating inductance and reluctance as a function of current and of airgap enables the position and the velocity of the armature to be determined accurately because the armature is not saturated magnetically in its operating range and because the flux is looped by passing mainly through the armature because of the shape of the pole pieces of the core.

The natural asymmetry of the top flux circuit compared with the bottom flux circuit can be exaggerated (to shorten starting time) by giving different slopes to the top pole surfaces 80 and to the bottom pole surfaces 82, while ensuring that facing pole surfaces remain mutually parallel.

What is claimed is:

1. An electromagnetic valve actuator for acruating a valve, comprising:

a valve drive armature, resilient return means arranged for holding the valve at rest in a predetermined position, substantially halfway between two extreme positions one of which is a closed position, electromagnetic means having a ferromagnetic core placed on both sides of the valve drive armature, and a power circuit for applying power in alternate time periods to said electromagnetic means, wherein said power circuit includes:

means for measuring an energization current generated by the power circuit in the electromagnetic means, means for calculating a velocity with which the armature approaches each of its extreme position by deriving said velocity from said energization current, and means for applying an energization current to the electromagnetic means in order to servo-control variation of said velocity, as provided by said calculation means for calculating a velocity, to a predetermined reference profile.

2. An actuator according to claim 1, wherein said calculation means are further arranged to repetitively calculate the inductance and the reluctance of the electromagnetic means as long as an airgap between the armature and the electromagnetic means exceeds a determined value, and the power supply circuit is arranged to control said velocity variation profile over a major portion of a full stroke of the armature from the closed position of the valve.

3. An actuator according to claim 2, wherein the electromagnetic means comprise a single coil mounted on a ferromagnetic circuit of structure such that in combination with the armature it presents two stable magnetic flux paths each corresponding to a zero value of the airgap between the armature and the ferromagnetic circuit.

4. An actuator according to claim 2, wherein the calculation means are designed to determine the inductance L(t) and the reluctance R(t) by calculating:

$$L(t) = \left[\int_{To}^{T} [u(t) - ri(t)]dt + L(To)i(to)\right] \Big/ i(t)$$

$$R(t) = \frac{n^2}{L(t)}$$

where:

r is a known resistance of the coil (possibly corrected as a function of temperature);

To is selected so that L(To)*i(To) is known; and n is a number of turns of the electromagnetic means.

5. An actuator according to claim 2, further having switch for energizing the electromagnetic means, controlled by a pulse width modulator which supplies a periodic output signal at a frequency fe of a few tens of kHz having a duty ratio that is controlled to cancel the difference between an estimated velocity profile $\hat{v}$ and a reference profile.

6. An actuator according to claim 2, wherein the calculation means are designed to transform the current reference into a magnetic flux reference and to compare the total flux created by the estimated real current with the leakage flux.

7. An actuator according to claim 6, wherein the calculation means comprise a current servo-control loop, a control loop for controlling a useful magnetic flux, and a velocity loop, such loops being mutually interleaved.

8. An actuator according to claim 1, wherein said electromagnetic means have a single coil on a ferromagnetic core and a laminated armature, said armature having pole surfaces that are chamfered and parallel to poles of the core.

9. An actuator according to claim 8, wherein the pole areas of the armature are of different values, whereby an asymmetry of a top flux circuit relative to a bottom flux circuit is increased.

10. An actuator according to claim 1, wherein said power circuit is arranged for carrying out the following steps:

sampling the current passing through the electromagnetic means, deriving variations in L(t) and R(t) from the current samples by calculation, deriving variations in an airgap (x) between the armature and the ferromagnetic core by referring to stored look-up tables, deriving a velocity from variations of the airgap versus time, and controlling a voltage applied to the electromagnetic means in such a manner as to servo-control variations in time of the airgap (x) and of the velocity (v) for compliance with a predetermined profile.

* * * * *

UNITED STATES PATENT AND TRADEMARK OFFICE

CERTIFICATE OF CORRECTION

PATENT NO. : 6,397,798 B1
DATED : June 4, 2002
INVENTOR(S) : Calogero Fiaccabrino It is certified that error appears in the above-identified patent and that said Letters Patent is hereby corrected as shown below:

Column 7,
Line 35, "acruating" should be replaced with -- actuating --.

Signed and Sealed this

Twenty-fifth Day of March, 2003

JAMES E. ROGAN
*Director of the United States Patent and Trademark Office*